US005139392A

United States Patent [19]

Pettitt et al.

[11] Patent Number: 5,139,392

[45] Date of Patent: Aug. 18, 1992

[54] MULTI-CYLINDER SWASH PLATE COMPRESSOR DISCHARGE GAS FLOW ARRANGEMENT

[75] Inventors: Edward D. Pettitt, Burt; Robert L. Swadner, East Amherst, both of N.Y.

[73] Assignee: General Motors Corporation, Detroit, Mich.

[21] Appl. No.: 685,245

[22] Filed: Apr. 15, 1991

[51] Int. Cl.[5] ..... F04B 1/16

[52] U.S. Cl. ..... 417/269; 417/312

[58] Field of Search ..... 417/312, 269, 270

[56] References Cited

U.S. PATENT DOCUMENTS

| | | | |
|---|---|---|---|
| 3,749,523 | 7/1973 | Wahl, Jr. . | |
| 3,904,320 | 9/1975 | Kishi et al. | 417/269 |
| 4,274,813 | 6/1981 | Kishi et al. | 417/312 X |
| 4,299,543 | 11/1981 | Shibuya | 417/269 |
| 4,351,227 | 9/1982 | Copp, Jr. et al. | 92/71 |
| 4,392,788 | 7/1983 | Nakamura et al. | 417/269 |
| 4,401,414 | 8/1983 | Ishizuka | 417/269 |
| 4,407,638 | 10/1983 | Sasaya et al. | 417/312 X |
| 4,511,313 | 4/1985 | Ishizuka et al. | 417/270 |
| 4,534,710 | 8/1985 | Higuchi et al. | 417/269 |
| 4,544,332 | 10/1985 | Shibuya | 417/269 |
| 4,583,922 | 4/1986 | Iijima et al. | 417/312 X |
| 4,610,604 | 9/1986 | Iwamori | 417/312 X |
| 4,704,073 | 11/1987 | Nomura et al. | 417/269 |
| 4,768,928 | 9/1988 | Miller | 417/269 |
| 4,790,727 | 12/1988 | Steele | 417/269 |
| 4,813,852 | 3/1989 | Ikeda et al. | 417/269 |
| 4,863,356 | 9/1989 | Ikeda et al. | 417/312 X |
| 4,934,482 | 6/1990 | Herron et al. | 417/269 X |
| 5,051,069 | 9/1991 | Ikeda et al. | 417/269 |

FOREIGN PATENT DOCUMENTS 56-44481 9/1979 Japan .

*Primary Examiner*—Leonard E. Smith
*Attorney, Agent, or Firm*—Ronald L. Phillips

[57] ABSTRACT

A refrigerant compressor assembly includes a shaft rotatably supported in a housing. A swash plate in disposed on the shaft, centrally within the housing. Three double-ended pistons are reciprocally supported on the swash plate within respective front and rear compression chambers for creating alternating compression and suction strokes in response to rotation of the swash plate. Refrigerant fluid discharged from the three front compression chambers is directed to a front discharge cavity and from the three rear compression chambers to a rear discharge cavity. The discharged fluid from the respective front and rear discharge cavities are each divided and then routed through equally restrictive flow passages to a primary and secondary mixing chamber. A first exhaust channel extends from the primary mixing chamber to an exhaust port of the compressor. A second exhaust channel extends from the secondary mixing chamber to the exit port and conveys the discharged fluid along a path having a greater restriction to fluid flow than the first exhaust channel. The discharged fluid flows from the first and second exhaust channels merge at or just upstream of the exit port.

4 Claims, 5 Drawing Sheets

MULTI-CYLINDER SWASH PLATE COMPRESSOR DISCHARGE GAS FLOW ARRANGEMENT

TECHNICAL FIELD

The subject invention relates to a multicylinder swash plate refrigerant compressor, and more particularly to a discharge gas routing arrangement in the compressor for attenuating pressure pulsations therein.

BACKGROUND ART

An inherent characteristic of a refrigerant compressor, such as used in an automotive air conditioning system, is the generation of dynamic pressure fluctuations, or pulsations, due to the dynamics of the compression process and the interaction of the gaseous refrigerant flow between the cylinders and the compressor. These pressure pulsations have the undesirable effect of vibrating certain components in the automotive air conditioning system, as well as components in the vehicle structure, which results in objectionable noise and/or destructive forces when the compressor rpm causes vibration at the resonant frequency of the system thus causing resonance. Also, the vibrating components are prone to more rapid wear and premature failure.

Swash plate refrigerant compressors having double-ended pistons are typically formed with an odd number of compression chambers at the front and rear ends of the compressor. For example, swash plate compressors may consist of three or five compression chambers at each end of the compressor. By forming an odd number of compression chambers on each side of the swash plate, only one compression chamber will be at the top dead center of the exhaust stroke at any one moment. Accordingly, in a six compression chamber compressor, i.e., three compression chambers at each of the front and rear ends of the compressor, there will be six equally spaced pressure pulsations per revolution of the swash plate. Hence, with each continued sixty degrees of rotation, the swash plate will move another piston to complete an exhaust stroke.

In theory, this equal spacing of exhaust strokes is highly advantageous because the discharge fluid pressure pulsations will be perfectly equally spaced in time from one another. In practice, however, the exhausted refrigerant from the front compression chambers is required to travel a greater distance to the exit port of the compressor than the exhausted refrigerant from the rear compression chambers. Therefore, the exhausted refrigerant from the front compression chambers must flow through a more restrictive path to the exit port. The additional distance and more restrictive flow path required to be traversed by the front compression chambers causes a time lag in the otherwise synchronized alternating pressure pulsations. Hence, when the exhaust flows from the front and rear compression chambers are mixed upstream of the exit port, they will no longer be perfectly spaced in time from each other.

At certain compressor speeds, this time lag can be so great as to cause the front compression chamber pressure pulsations to shift into phase with the rear compression chamber pulsations, thus causing destructive pressure pulsations of double magnitude throughout the system. That is, in a six cylinder swash plate compressor where one pressure pulsation normally occurs every sixty degrees of swash plate rotation, the additional time lag imposed on the three front compression chambers at certain rpm will sufficiently delay the merging of exhausted refrigerant fluid from the front compression chambers with the discharged fluid from the rear compression chambers so that one pressure pulsation of double magnitude occurs every one hundred and twenty degrees of swash plate rotation. Hence, at certain compressor speeds, instead of six pressure pulsations of a given magnitude chronologically spaced every sixty degrees of swash plate rotation, there will be three pressure pulsations of twice the given magnitude chronologically spaced every one hundred and twenty degrees of swash plate rotation.

In order to overcome this inherent defect, the prior art has taught to centrally locate the exit port between the front and rear compression chambers. For example, as shown in the U.S. Pat. No. 3,904,320 to Kishi et al, issued Sept. 9, 1975, and U.S. Pat. No. 4,863,356 to Akeda et al, issued Sept. 4, 1989, the exit port can be disposed midway between the front and rear ends of the compressor. Discharge flow passages extending from the front and rear compression chambers have substantially equal flow restrictions so that the pressure pulsations in the discharged fluid are always mixed out of phase. Hence, according to the Akeda et al '356 and the Kishi et al '320 teachings, a swash plate compressor having six compression chambers will be assured to have six equally chronologically spaced pressure pulsations per revolution at the exit port.

Although the prior art teachings are helpful in reducing the problem of phase shift, or time lag, in the discharge pressure pulsations, they are still insufficient to effectively muffle, or attenuate, all of the destructive pressure pulsations.

SUMMARY OF THE INVENTION AND ADVANTAGES

The subject invention provides a refrigerant compressor assembly for compressing and discharging a recirculated flow of refrigerant fluid. The assembly comprises a housing including a discharge fluid exit port, a front compression chamber disposed in the housing, a front piston slidably disposed in the front compression chamber for cyclically discharging fluid from the front compression chamber and creating a cyclic discharge pressure pulsation, a rear compression chamber disposed in the housing, a rear piston slidably disposed in the rear compression chamber for cyclically discharging fluid from the rear compression chamber and creating a cyclic discharge pressure pulsation, rotary displacement means operatively coupled to the front and rear pistons for chronologically alternating the discharge pressure pulsation of the front piston with respect to the rear piston, and mixer means including a mixing chamber for routing the discharged fluid from the front and rear compression chambers through substantially equally restrictive flow passages to the mixing chamber and mixing together the discharged fluids while maintaining the chronological alternations of the discharged pressure pulsations. The improvement comprises a flow divider means downstream of the mixer means for staggering the chronologically alternating discharged pressure pulsations at the exit port and thereby diminishing the magnitude of pressure pulsations in the discharged fluid.

The subject invention improves on the prior art teachings by providing an intermediate mixing chamber where the pressure pulsations from the front and rear compression chambers are mixed out of phase, i.e., in a chronologically alternating pattern. The flow divider means then directs the discharged fluid from the mixing chamber to the exit port via two separate paths. One path is more restrictive to fluid flow than the other path so that during a majority of operating speeds the pressure pulsations are shifted, or staggered, in time, at the exit port to diminish the pressure pulsations in the discharged fluid by a magnitude of one half. Therefore, in a compressor having six compression chambers, twelve half magnitude pressure pulsations will occur at the exit port with each revolution of the rotary displacement means, as compared to six equally spaced pulsations of one full magnitude provided by the prior art. Thus, the damaging pressure pulsations will be substantially diminished and internal muffling is accomplished to alleviate the undesirable effects inherent in the prior art compressors.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
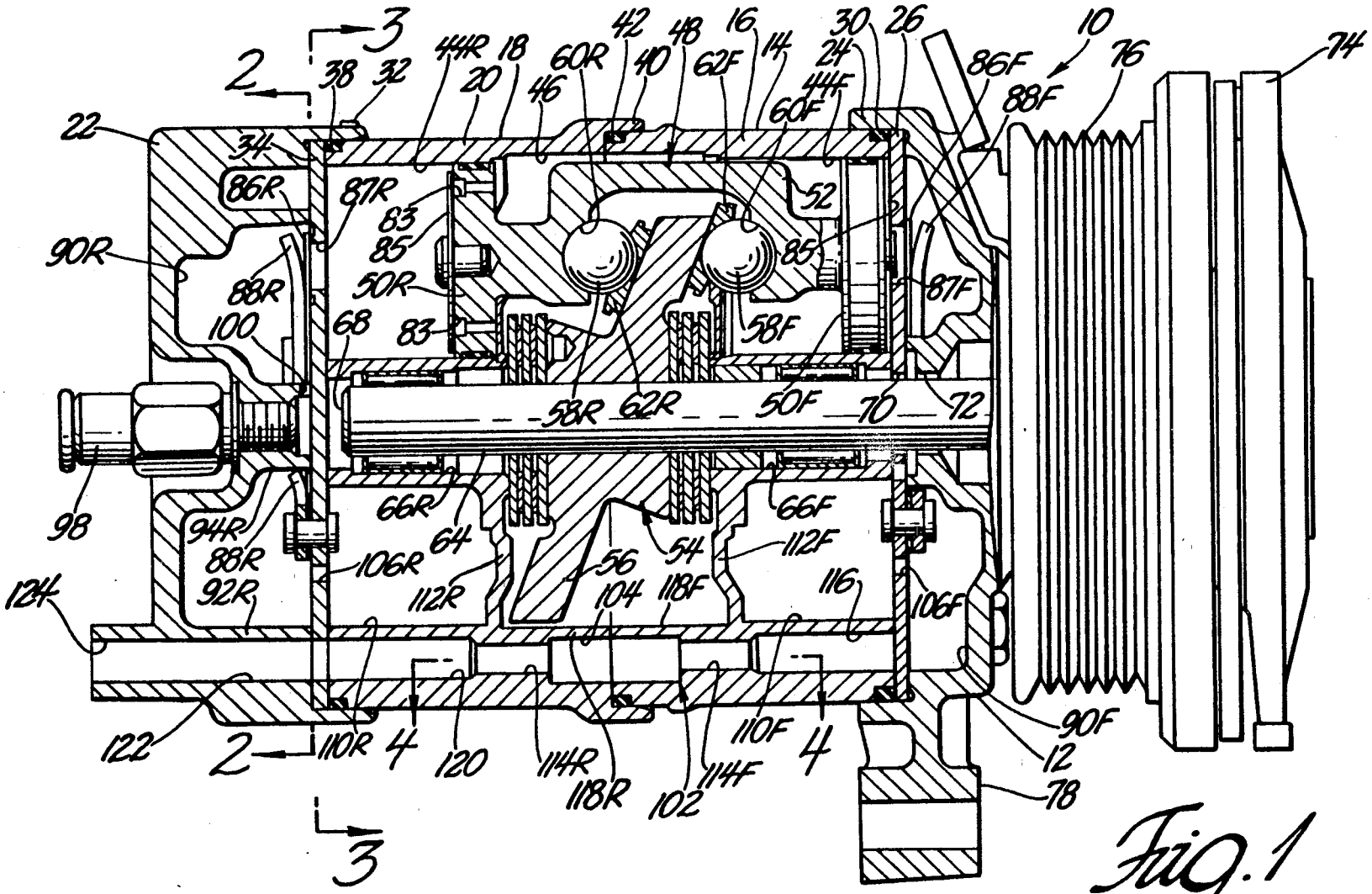
FIG. 1 is a cross-sectional view of a refrigerant compressor according to the subject invention.

Referring to the Figures, wherein like numerals indicate like or corresponding parts throughout the several views, a refrigerant compressor assembly according to the subject invention is generally shown at 10 in FIG. 1. The compressor assembly 10 is a swash plate-type refrigerant compressor intended for vehicular use for compressing and discharging a recirculated flow of refrigerant fluid.

Referring to FIG. 1, the compressor assembly 10 includes a plurality of die-cast aluminum parts, including a front head 12, a front cylinder block 14 with an integral cylindrical shell or housing 16, a rear cylinder block 18 with an integral cylindrical shell or housing 20, and a rear head 22. The front head 12 has a cylindrical collar 24 which telescopingly fits over the front end of the front cylinder block housing 16 with a rigid, circular front valve plate 26 of steel sandwiched therebetween and an O-ring seal 30 provided at their common juncture.

Similarly, the rear head 22 includes a cylindrical collar 32 disposed telescopically over the rear end of the rear cylinder block housing 20 with a rigid, circular rear valve plate 34 of steel sandwiched therebetween and an O-ring seal 38 providing sealing at their common juncture. At the juncture of the front 14 and rear 18 cylinder blocks, the rear cylinder block housing 20 includes a cylindrical collar 40 at its forward end which telescopically fits over the rearward end of the cylinder block housing 16 and there is provided an O-ring seal 42 to seal this joint in the transversely split two-piece cylinder block thus formed.

The front and rear cylinder blocks 14, 18 each have a cluster of three equally angularly and radially spaced and parallel thin-walled cylinders forming compression chambers 44F and 44R, respectively, with the suffixes F and R being used herein to denote front and rear counterparts in the compressor assembly 10. The compression chambers 44F, 44R in each cluster are integrally joined along their length with each other both at the center of their respective cylinder block 14, 18 and at their respective cylinder block housing 16, 20. The chambers 44R are detailedly shown in FIGS. 5–9 with it being understood that chambers 44F in cylinder block 14 are the same configuration but of reverse hand. The compression chambers 44F in the front cylinder block 14 are axially aligned with the compression chambers 44R in the rear cylinder block 18. The outboard end of each compression chamber 44F, 44R is closed by the respective front and rear valve plate 26, 34. The oppositely facing inboard ends of the aligned compression chambers 44F, 44R are axially spaced from each other and, together with the remaining inboard end details of the cylinder blocks 14, 18 and the interior of their respective integral housings 16, 20, respectively, form a central crank case cavity 46 in the compressor assembly 10. In what will be referred to as the normal or in-use orientation of the compressor assembly 10, the three pairs of aligned compression chambers 44F, 44R are located as shown in FIGS. 5–9 at or close to the 2, 6, and 10 o'clock positions with the two adjoining upper compression chambers in each cylinder block 14, 18 designated 44F (*a*), 44R (*a*), and 44F (*b*), 44R (*b*), and the lowermost compression chamber designated 44F (*c*), 44R (*c*).

A symmetrical double-ended piston, generally indicated at 48 in FIG. 1, is fabricated of aluminum and is reciprocally mounted in each pair of axially aligned compression chambers 44F, 44R with each piston 48 having a short, cylindrical front head 50F and a short cylindrical rear head 50R of equal diameter which slide in the respective front 44F and rear 44R compression chambers. The two heads 50F, 50R of each piston are joined by a bridge 52 spanning the crank case cavity 46. The pistons 48 cyclically intake and discharge refrigerant fluid from their respective compression chambers 44F, 44R and, upon discharge, create a cyclic discharge pressure pulsation in the fluid.

A rotary displacement means, generally indicated at 54 in FIG. 1 is operatively coupled to the front and rear piston heads 50F and 50R for chronologically alternating the discharge pressure pulsation of the front piston heads 50F with respect to the rear piston heads 50R. More specifically, the three pistons 48 are driven in a conventional manner by the rotary displacement means, wherein a swash plate 56 drives the pistons 48 from each side through a ball 58F, 58R which fits in a socket 60F, 60R and a slipper 62F, 62R which slidably engages the respective sides of the swash plate 56.

The swash plate 56 is fixed to and driven by a drive shaft 64 rotatably supported and axially contained on opposite sides of the swash plate 56 in the two-piece cylinder block 14, 18 by a bearing arrangement. More specifically, the front cylinder block 14 and the rear cylinder block 18 include a shaft bore 66F, 66R, respectively, disposed centrally therethrough. A rear end 68 of the drive shaft 56 terminates within the rear cylinder block shaft bore 66R adjacent the rear valve plate 34. The opposite end of the drive shaft 64 extends through the front cylinder block shaft bore 66F through a central hole 70 in the front valve plate 26 and thence outwardly through an aligned hole 72 in a tubular extension which projects outwardly from and is integral with the front head 12. The drive shaft 64 is adapted to be secured with the aid of a thread on the end thereof to a clutch 74 of conventional type which is engagable to clutch the drive shaft 64 to a pulley 76 which is concentric therewith and in the case of a vehicle installation is belt driven from the engine.

For mounting the compressor, three mounting arms 78, only one of which is shown in FIG. 1, are integrally formed with the front head 12 at the 3, 6, and 9 o'clock positions so that the force due to the drive tension is transferred directly to the mounting bracket to which these arms 78 are to be attached.

Figure 2:
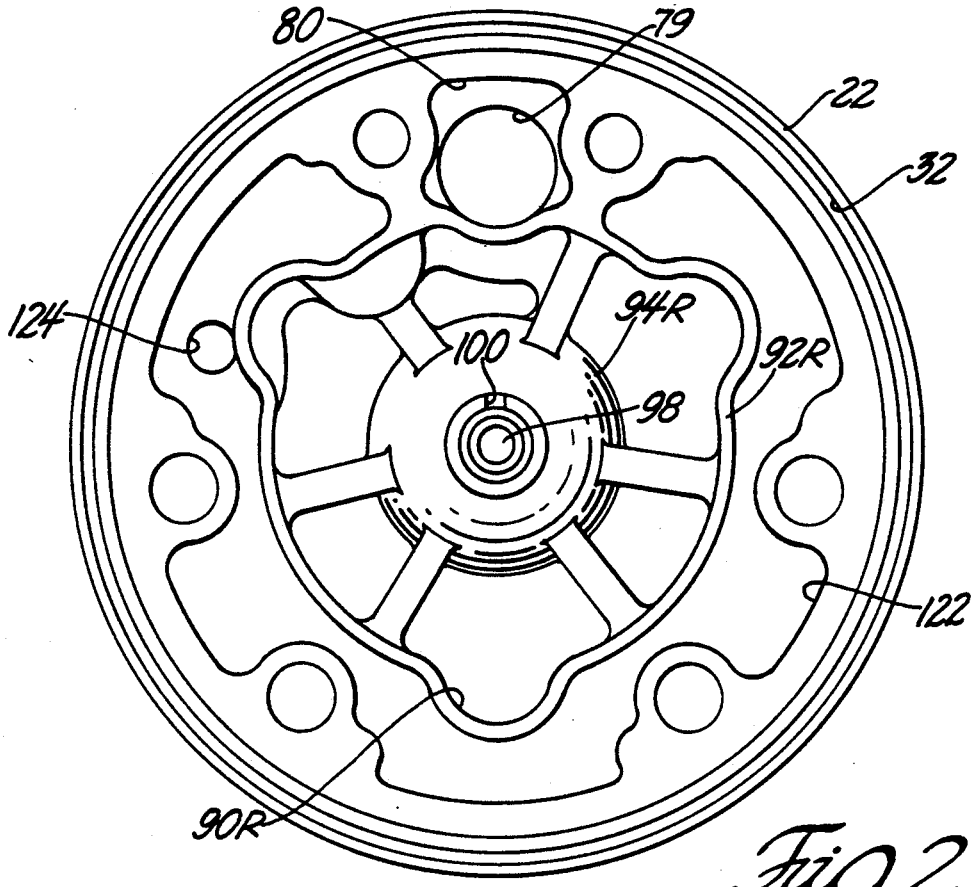
FIG. 2 is a front view of the rear head as taken along lines 2—2 of FIG. 1.
Figure 3:
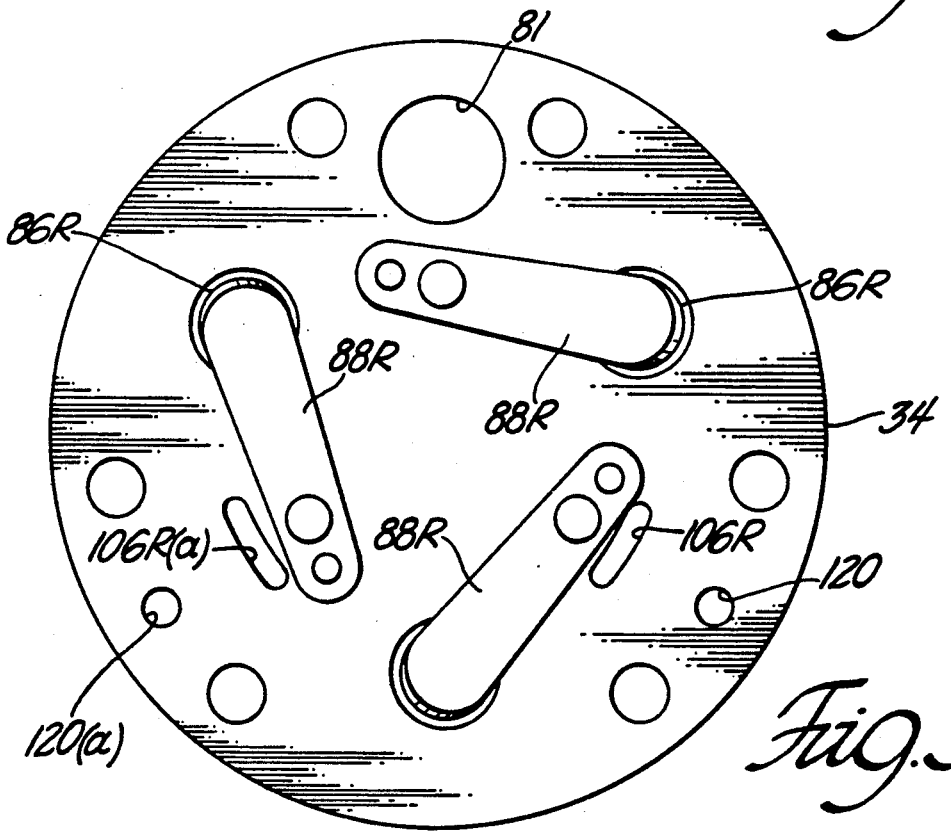
FIG. 3 is a rear view of the rear valve plate as taken along lines 3—3 of FIG. 1.
Figure 4:
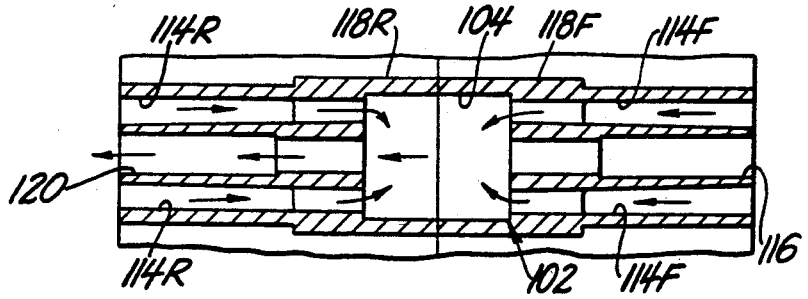
FIG. 4 is a fragmentary view of the primary mixing chamber as taken along lines 4—4 of FIG. 1.
Figure 5:
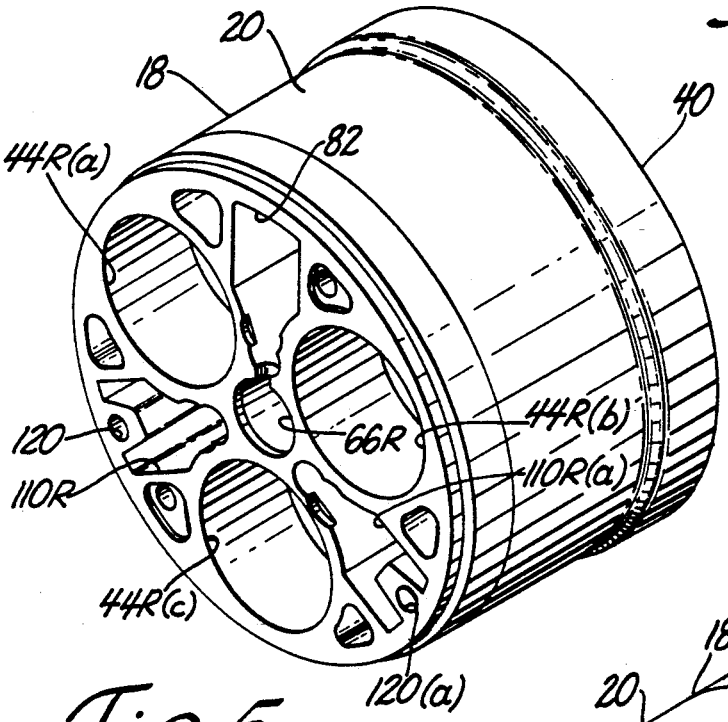
FIG. 5 is a rear perspective view of the rear cylinder block.

Describing now the refrigerant flow system within the compressor assembly 10, gaseous refrigerant with some oil entrained therein enters through an inlet 79 in the rear head 22 and into a small cavity 80 in the rear head 22 as shown in FIG. 2. The entering refrigerant is directed through the rear cavity 80 to a circular upper aperture 81 in the rear valve plate 34, shown in FIG. 3, and then into a refrigerant transfer passage 82 formed by a generally rectangular-shaped passage in the rear cylinder block 18, as shown in FIGS. 3–9. Because the front cylinder block 14 is identical to the rear cylinder block 18 except for the collar 40, the front cylinder block 14 also includes a corresponding refrigerant transfer passage which is redundant since the front head 12 never contains low pressure refrigerant. Spaced radially below the refrigerant transfer passage 82 is an oil separation passage 84 formed by a rectangular-shaped opening in the rear cylinder block 18 and open intermediate its length to the central crank case cavity 46. The oil separation passage 84 induces oil separation from the passing refrigerant for lubricating the rotary displacement means 54 and the pistons 48. Accordingly, incoming refrigerant is directed through the rear head 22, the rear valve plate 34, and the rear cylinder block 18 to the central crank case cavity 46.

Each of the piston heads 50F, 50R of each of the pistons 48 include nine intake holes 83 disposed axially therethrough as shown in FIG. 1. The intake holes 83 are each approximately 0.125 inches in diameter. The intake holes 83 are disposed in equal radial increments about an arc of 270 degrees. An intake valve disk 85 of spring steel is fastened on the respective piston head 50F, 50R by a rivet. As each piston head 50F, 50R is pulled through a suction stroke in its compression chamber 44F, 44R, a pressure differential is created allowing refrigerant fluid from the central crankcase cavity 46 to enter the respective compression chamber 44F, 44R by way of the nine intake holes 83 and the intake valve disk 85.

For the discharge of refrigerant upon compression thereof in the compression chambers 44F, 44R, there are formed separate discharge ports 87F, 87R in the respective valve plates 26, 34 as shown in FIG. 1. Opening and closing of the respective discharge ports is effected by separate reed-type discharge valves 86F, 86R of spring steel which are backed up by rigid retainers 88F, 88R. The discharge ports 87F, 87R are opened by their respective discharge valves 86F, 86R to a generally annular discharge chamber 90F, 90R in the respective front and rear heads 12, 22.

The rear discharge chamber 90R is formed by the inboard side of the rear head 22, an interior cylindrical wall 92R extending from the rear head 22, and a central inboard projecting extension 94R extending from the inboard side of the rear head 22, and by the outboard side of the rear valve plate 34. A typical high pressure relief valve 98 is threaded in the rear head 22 centrally within the inboard projecting extension 94R and communicates with the rear discharge chamber 90R via a radial bore 100.

The front and rear discharge chambers 90F, 90R communicate with a mixer means, generally indicated at 102 in FIGS. 1 and 4 through 10, and which includes a centrally located mixing chamber 104. The mixer means 102, routes the discharged fluid from the front and rear compression chambers 44F, 44R through substantially equally restrictive flow passages to the mixing chamber 104. That is, the resistance to refrigerant fluid flow through the mixer means 102 is substantially equivalent for both the front compression chambers 44F and the rear compression chambers 44R. At the mixing chamber 104, the discharged refrigerant fluid from both the front 44F and rear 44R compression chambers are mixed together.

As each exhaust, or compression, stroke of the front 50F and rear 50R piston heads causes a pressure pulsation in the discharged fluid and because there is an odd number of pistons 48 arranged in equal circumferential increments about the swash plate 56, the pressure pulsations alternate in a chronologically staggered fashion between the front 44F and rear 44R compression chambers. Therefore, a six compression chamber compressor will have six equally spaced compression strokes per revolution of the swash plate 56. Hence, because the mixer means 102 forces the discharged fluid from both the front 44F and rear 44R compression chambers to pass through equally restrictive flow passages to the mixing chamber 104, the chronologically staggered, or alternating, discharge pressure pulsations are maintained so that in the mixing chamber 104 six equally spaced pressure pulsations occur with each full revolution of the swash plate 56.

Figure 6:
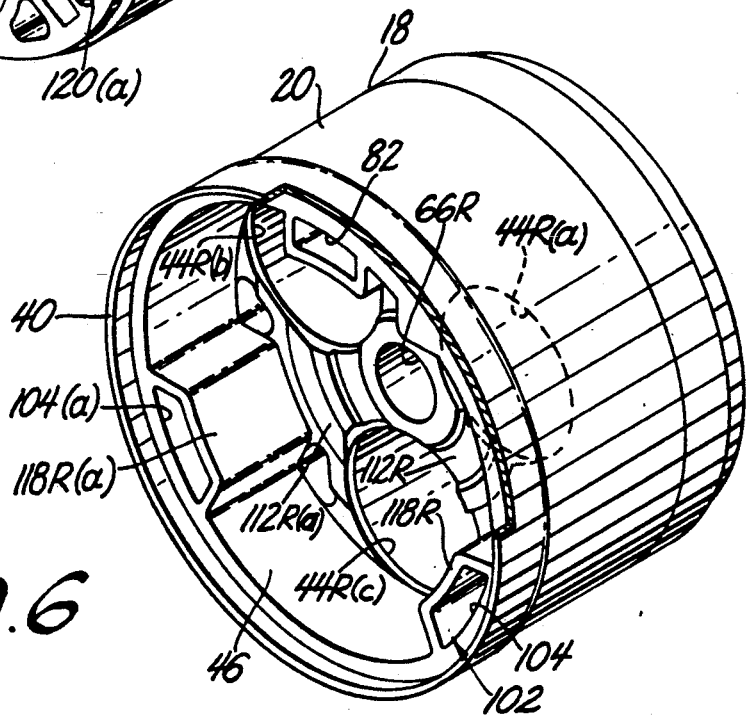
FIG. 6 is a front perspective view of the rear cylinder block.
Figure 7:
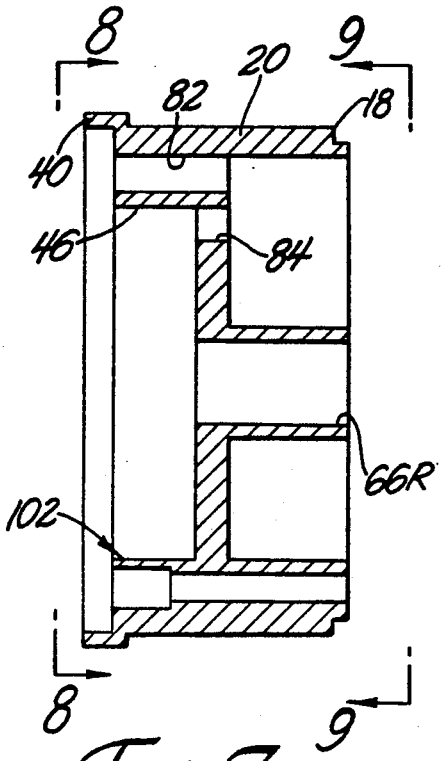
FIG. 7 is a cross-sectional view of the rear cylinder block as taken along lines 7—7 of FIG. 8.
Figure 8:
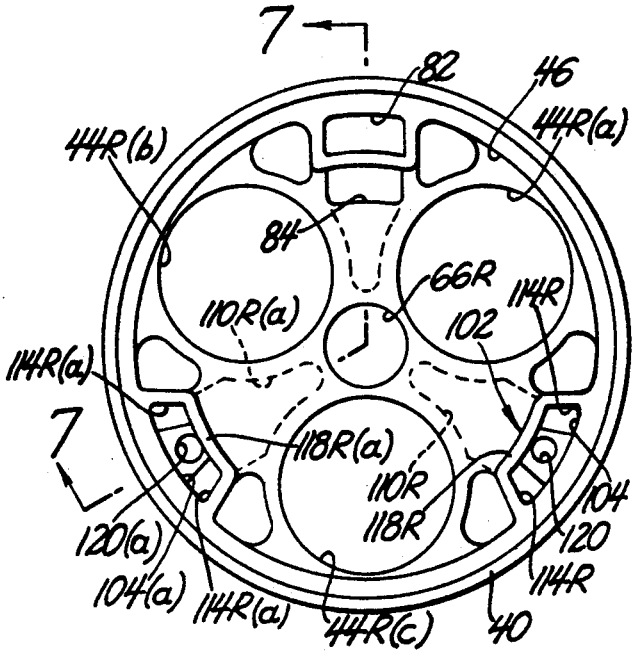
FIG. 8 is a front view of the rear cylinder block of the subject invention.
Figure 9:
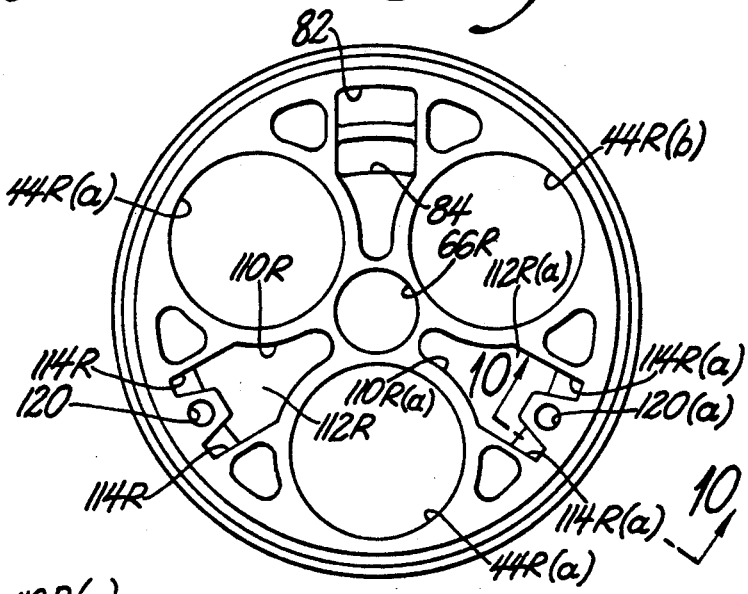
FIG. 9 is a rear view of the rear cylinder block as seen along line 9—9 of FIG. 8.
Figure 10:
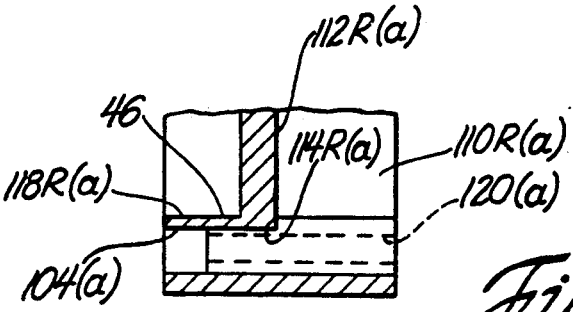
FIG. 10 is a fragmentary cross-sectional view of the first rear flow passage as taken along line 10—10 of FIG. 9.

More specifically, and referring now to FIGS. 6, 8, and 9, the mixer means 102 is shown to include a primary mixing chamber 104 and a secondary mixing chamber **104(*a*) on opposite sides of the cylinder blocks 14, 18. The primary 104 and secondary 104(*a*) mixing chambers are substantially identical and receive equal quantities of discharged refrigerant fluid from the respective compression chambers 44F, 44R. The front valve plate 26 includes an arcuate opening 106F in communication with the front discharge chamber 90F for directing discharged refrigerant fluid from the front discharge chamber 90F to a first front pocket 110F. The first front pocket 110F is a generally triangular-shaped hollow formed between the front compression chamber 44F**(*a*) and the front compression chamber 44F(*c*), and the inboard side of the front cylinder block housing 16, and bounded on opposite axial ends by a radially extending front first separator plate 112F and the front valve plate 26. A pair of first front flow passages 114F communicate with the first front pocket 110F and have a generally trapezoidal shape. The shape of these passages and corresponding passages 114R in the rear housing 20 are best shown in FIGS. 8 and 9. The pair of first front flow passages 114F, therefore, communicate with the front compression chambers 44F by receiving discharged refrigerant fluid and then conveying the discharged fluid to the primary mixing chamber 104.

Separating the pair of first front flow passages 114F is a redundant, or dummy, exhaust channel 116. In the front cylinder block 14, the exhaust channel 116 serves no purpose. However, since the front 14 and rear 18 cylinder blocks are of substantially identical construction and since an exhaust channel is required in the rear cylinder block 18 as will be described subsequently, the redundant exhaust channel 116 is merely plugged at one end by the front valve plate 26, as shown in FIG. 1. That is, because it is imperative that the flow restrictions to the mixing chambers 104, 104(*a*) from the front 12 and rear 22 heads be equivalent, and since the refrigerant must flow around an exhaust channel in the rear cylinder block 18, the front cylinder block 14 is symmetrically provided with the redundant exhaust channel 116.

Similarly, the front valve plate 26 includes an arcuate opening (not shown) for conveying discharged fluid from the front discharge chamber 90F to a front second pocket (not shown). The front second pocket is formed between the front compression chamber 44F(*b*) and the front compression chamber 44F(*c*), as shown in FIGS. 5–9. A front second separator plate (not shown) extends radially to define one end of the front second pocket. Also, a pair of second front flow passages (not shown) communicate discharge fluid from the front second pocket to the secondary mixing chamber 104(*a*). The resistance to fluid flow through the second front pocket and the pair of second front flow passages is substantially equal to the flow resistance in the front cylinder block 14 leading to the primary mixing chamber 104.

A generally trapezoidal shaped shroud 118F extends inwardly from the front first separator plate 112F and like but not shown second separator plate for enclosing the first front flow passage 114F and like but not shown second front flow passage. The shrouds 118F, together with corresponding first and second shrouds 118R, 118R(*a*) extending from the rear cylinder block 18, form the primary 104 and secondary 104(*a*) mixing chambers. The relationship of the respective shrouds for primary mixing chamber 104 is best illustrated in FIG. 1.

Referring now to the discharge flow routing in the rear cylinder block 18, and to FIGS. 1–10, an opening 106R is provided in the rear valve plate 34 and communicates with the rear discharge chamber 90R for communicating fluid discharged through the discharge chamber 90R to a first rear pocket 110R. The first rear pocket 110R is formed between two adjacent compression chambers 44R(*a*) and 44R(*c*) in a manner identical to that in the front cylinder block 14, as described above, so that upon abutting and fastening the front cylinder block 14 and the rear cylinder block 18 in an operational position, the first front pocket 110F and first rear pocket 110R are axially aligned. A pair of first rear flow passages 114R communicate discharged fluid from the first rear pocket 110R to the primary mixing chamber 104. The first rear flow passages 114R have a generally trapezoidal shape and provide a resistance to fluid flow therethrough substantially equal to the flow resistance through the first front flow passages 114F. A fully operational first exhaust channel 120 is disposed between the pair of first rear flow passages 114R, in a manner similar to that described above in connection with the redundant exhaust channel 116.

A second rear pocket 110R(*a*) is disposed in the rear cylinder block 18, between two adjacent compression chambers 44R(*b*), 44R(*c*), in a manner similar to that described above in connection with the front cylinder block 14. A pair of second rear flow passages 114R(*a*) (FIGS. 8 and 9) extend between the second rear pocket 110R(*a*) and the secondary mixing chamber 104(*a*). As above, the flow restriction through the pair of second rear flow passages 114R(*a*) is substantially equal to the fluid flow resistance through the first front flow passages 114F. A second exhaust channel 120(*a*) is disposed between the pair of second rear flow passages 114R(*a*) and conveys the discharged fluid from the secondary mixing chamber 104(*a*). The first 120 and second 120(*a*) exhaust channels terminate in fluid communication with a rear head outer chamber 122. An exit port 124 opens to the rear head outer chamber 122 for directing the high pressure discharged refrigerant fluid into the cooling circuit.

The first exhaust channel 120 is positioned significantly closer to an exit port 124 in head 22, as shown in FIG. 1, than the second exhaust channel 120(*a*). The result is that fluid moving from the secondary mixing chamber 104(*a*) to the exhaust port 124 is forced to travel along a more restrictive path than the discharged fluid moved from the primary mixing chamber 104 to the exit port 124. This causes the chronologically alternating pressure pulsations which are synchronized between the primary 104 and secondary 104(*a*) mixing chambers to become staggered in time, or shifted out of phase, by the time the two flows converge at or just upstream of the exit port 124. Accordingly, instead of six pressure pulsations at full magnitude for every revolution of the swash plate 56, the staggered mixed flows from the first exhaust channel 120 and the second exhaust channel 120(*a*) will mix at the exit port 122 having twelve pressure pulsations at one half magnitude per revolution of the swash plate 56. This staggering of the chronologically alternating pressure pulsations at the exit port 124 substantially diminishes the magnitude of the pressure pulsations in the discharged fluid, i.e., by a factor of one half, and eliminates the need for externally mounted muffling devices.

Figure 11:
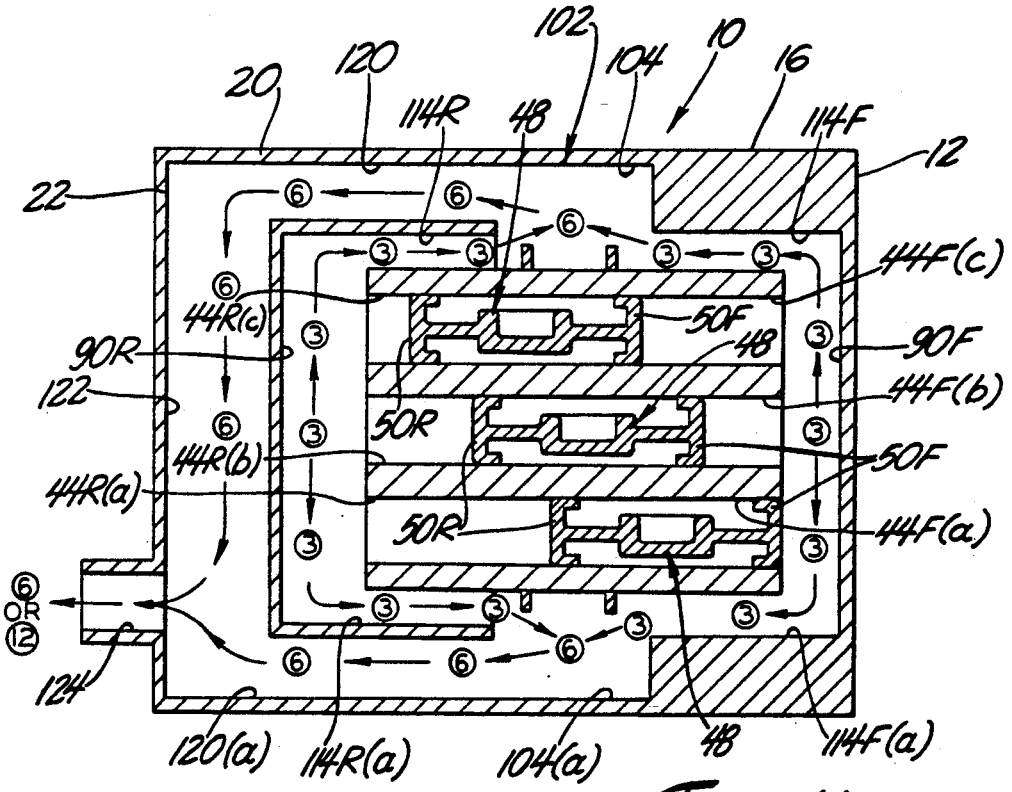
FIG. 11 is a schematic view of the subject compressor showing the discharge fluid routing arrangement.

FIG. 11 schematically illustrates the chronologically alternating pressure pulsations for each revolution of the swash plate 56. In each of the primary 104 and secondary 104(*a*) mixing chambers, the six pressure pulsations per revolution are perfectly mixed in the chronologically alternating fashion. By splitting the discharged flows between the two mixing chambers 104, 104(*a*) and then remixing them after forcing them to travel through unequally restrictive passages, the magnitude of each pressure pulsation is cut in half. By shifting the chronologically alternating pressure pulsations from the secondary mixing chamber 104(*a*), i.e., by forcing the flow to travel through a more restrictive path, the converging flow at the exit port 124 comprises twelve pressure pulsations per revolution of the swash plate 56, at half pulsation magnitude. Of course, at certain operating speeds of the compressor assembly 10, the time lag caused in the discharged flow from the secondary mixing chamber 104(*a*) may fall behind the flow from the primary mixing chamber 104 by one full amplitude so that the flows are remixed in phase, but this occasional worst case result merely places the subject compressor assembly 10 on equal footing with the prior art wherein six pressure pulsations per revolution are created.

Figure 12:
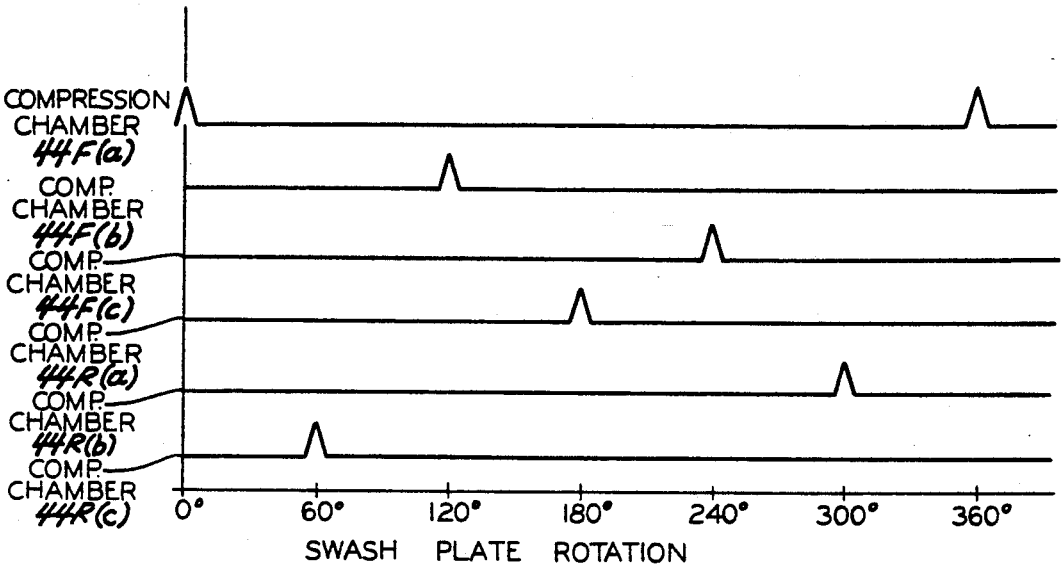
FIG. 12 is a simplified graphic representation of the chronologically alternating pressure pulsations created in each of the six compression chambers of the subject invention.

FIG. 12 graphically illustrates the chronological order of pressure pulsations occurring in each of the six compression chambers 44F, 44R for one revolution of the swash plate 56.

The invention has been described in an illustrative manner, and is to be understood that the terminology which has been used is intended to be in the nature of words of description rather than of limitation.

Obviously many modifications and variations of the present invention are possible in light of the above teachings. It is, therefore, to be understood that within the scope of the appended claims the invention may be practiced otherwise than as specifically described.

What is claimed is:

1. An refrigerant compressor assembly for compressing and discharging a recirculated flow of refrigerant fluid, said assembly comprising:

a housing including a discharge fluid exit port;

a front compression chamber disposed in said housing;

a front piston slideably disposed in said front compression chamber for cyclically discharging fluid from said front compression chamber and creating a cyclic discharge pressure pulsation;

a rear compression chamber disposed in said housing;

a rear piston slideably disposed in said rear compression chamber for cyclically discharging fluid from said rear compression chamber and creating a cyclic discharge pressure pulsation;

rotary displacement means operatively coupled to said front and rear pistons for chronologically alternating said discharge pressure pulsation of said front piston with respect to said rear piston;

mixer means including a mixing chamber for routing the discharged fluid from said front and rear compression chambers through substantially equally restrictive flow passages to said mixing chamber and mixing together the discharged fluids while maintaining said chronological alternations of said discharge pressure pulsations;

and flow divider means downstream of said mixer means for staggering said chronologically alternating discharge pressure pulsations at said exit port and thereby diminishing the magnitude of pressure pulsations in the discharged fluid.

2. An axial refrigerant compressor assembly for compressing and discharging a recirculated flow of refrigerant fluid, said assembly comprising:

a housing including a discharge fluid exit port and having a front end and an axially spaced rear end;

a front compression chamber disposed in said housing adjacent said front end;

a front piston axially slideably disposed in said front compression chamber for cyclically discharging fluid from said front compression chamber and creating a cyclic discharge pressure pulsation;

a rear compression chamber disposed in said housing adjacent said rear end;

a rear piston slideably disposed in said rear compression chamber for cyclically discharging fluid from said rear compression chamber and creating a cyclic discharge pressure pulsation;

rotary displacement means operatively coupled to said front and rear pistons for chronologically alternating said discharge pressure pulsation of said front piston with respect to said rear piston;

mixer means including a mixing chamber for routing the discharged fluid from said front and rear compression chambers through substantially equally restrictive flow passages to said mixing chamber and mixing together the discharged fluids while maintaining said chronological alternations of said discharge pressure pulsations;

and flow divider means extending between said mixing chamber and said exit port for dividing and conveying the mixed discharged fluids between two unequally restrictive channels and then remerging the discharged fluids at said exit port to stagger said chronologically alternating discharge pressure pulsations and thereby diminish the magnitude of pressure pulsations in the discharged fluid exiting said exit port.

3. An axial piston refrigerant compressor assembly for compressing and discharging a recirculated flow of refrigerant fluid, said assembly comprising:

a housing having a front end and an axially spaced rear end and including a discharge fluid exit port;

a front compression chamber axially disposed in said housing adjacent said front end;

a front piston slideably disposed in said front compression chamber for cyclically discharging fluid from said front compression chamber and thereby creating a cyclic discharge pressure pulsation;

a rear compression chamber axially disposed in said housing adjacent said rear end;

a rear piston axially slideably disposed in said rear compression chamber for cyclically discharging fluid from said rear compression chamber and thereby creating a cyclic discharge pressure pulsation;

rotary displacement means operatively coupled to said front and rear pistons for chronologically alternating said discharge pressure pulsations of said front piston with respect to said rear piston;

a primary mixing chamber;

a secondary mixing chamber;

a first front flow passage extending from said front compression chamber to said primary mixing chamber and having a predetermined flow resistance;

a second front flow passage extending from said front compression chamber to said secondary mixing chamber and having a flow resistance substantially equal to said first front flow passage;

a first rear flow passage extending from said rear compression chamber to said primary mixing chamber and having a flow resistance substantially equal to said first front flow passage;

a second rear flow passage extending from said rear compression chamber to said secondary mixing chamber and having a flow resistance substantially equal to said first front flow passage;

a first exhaust channel extending between said primary mixing chamber and said exit port and having a predetermined fluid flow restriction;

and a second exhaust channel extending between said secondary mixing chamber and said exit port and having a predetermined fluid flow restriction greater than said fluid flow restriction of said first exhaust channel.

4. An axial piston refrigerant compressor assembly for compressing a recirculated flow of refrigerant fluid, said assembly comprising:

a housing having a front end and an axially spaced rear end and including a fluid exit port;

a plurality of front compression chambers axially disposed in said housing adjacent said front end;

a front piston slideably disposed in each of said front compression chambers for cyclically discharging fluid therefrom and creating cyclic discharge pressure pulsations;

a plurality of rear compression chambers axially disposed in said housing adjacent said rear end;

a rear piston slideably disposed in each of said rear compression chambers for cyclically discharging fluid therefrom and creating cyclic discharge pressure pulsations;

rotary displacement means operatively coupled to each of said front and rear pistons for chronologically alternating said discharge pressure pulsations of each of said front pistons with respect to each of said rear pistons;

a primary mixing chamber;

a secondary mixing chamber;

a pair of first front flow passages extending from said front compression chambers to said primary mixing chamber and having a predetermined flow resistance;

a pair of second front flow passages extending from said front compression chambers to said secondary mixing chamber and having a flow resistance substantially equal to said first front flow passages;

a pair first rear flow passages extending from said rear compression chambers to said primary mixing chamber and having a flow resistance substantially equal to said first front flow passages;

a pair of second rear flow passages extending from said rear compression chambers to said secondary mixing chamber and having a flow resistance substantially equal to said first front flow passages;

a first exhaust channel extending between said primary mixing chamber and said exit port and having a predetermined fluid flow restriction;

and a second exhaust channel extending between said secondary mixing chamber and said exit port and having a predetermined fluid flow restriction greater than said fluid flow restriction of said first exhaust channel.

* * * * *